US009044640B2

(12) United States Patent
Lo

(10) Patent No.: US 9,044,640 B2
(45) Date of Patent: Jun. 2, 2015

(54) ELLIPSE EXERCISER WITH INCLINATION ADJUSTMENT UNIT

(71) Applicant: Chiu-Hsiang Lo, Taichung (TW)

(72) Inventor: Chiu-Hsiang Lo, Taichung (TW)

( * ) Notice: Subject to any disclaimer, the term of this patent is extended or adjusted under 35 U.S.C. 154(b) by 85 days.

(21) Appl. No.: 13/934,197

(22) Filed: Jul. 2, 2013

(65) Prior Publication Data

US 2015/0018173 A1 Jan. 15, 2015

(51) Int. Cl.
*A63B 22/04* (2006.01)
*A63B 22/06* (2006.01)

(52) U.S. Cl.
CPC ..... *A63B 22/0664* (2013.01); *A63B 2022/0676* (2013.01)

(58) Field of Classification Search
CPC ..... A63B 22/0015; A63B 22/0023; A63B 22/0664; A63B 2022/0676
USPC ..... 482/51–54, 908, 57, 62, 70
See application file for complete search history.

(56) References Cited

U.S. PATENT DOCUMENTS

| | | | | |
|---|---|---|---|---|
| 7,654,936 | B2 * | 2/2010 | Liao et al. | 482/52 |
| 7,691,035 | B2 | 4/2010 | Chen et al. | |
| 7,846,071 | B2 * | 12/2010 | Fenster et al. | 482/52 |
| 7,946,962 | B2 * | 5/2011 | Long | 482/52 |
| 2007/0060449 | A1 * | 3/2007 | Lo | 482/52 |
| 2012/0190507 | A1 * | 7/2012 | Murray | 482/52 |

* cited by examiner

*Primary Examiner* — Stephen Crow
*Assistant Examiner* — Gregory Winter

(57) ABSTRACT

An ellipse exerciser includes a base, a rail frame having two rails, an ellipse unit having two pedals and two roller units, and an adjustment unit having a bottom part and a support frame. The roller units are moved along the rails of the rail frame. The bottom part has two slots and each slot has teeth. Two guide boards are pivotably connected to the two respective outsides of the bottom part. Each guide board is connected with a spring. The support frame has a rod and two ends of the rod are respectively engaged with the slots. The guide boards each have a stop portion to guide the rods. When the support frame is rotated to different angular positions relative to the bottom part, the rods are engaged with different teeth so as to adjust the inclination of the rails.

7 Claims, 9 Drawing Sheets

ELLIPSE EXERCISER WITH INCLINATION ADJUSTMENT UNIT

FIELD OF THE INVENTION

The present invention relates to an ellipse exerciser, and more particularly, to an ellipse exerciser with an inclination adjustment unit.

BACKGROUND OF THE INVENTION

The conventional ellipse exerciser generally comprises a base, a rail frame, an ellipse unit and an adjustment unit, wherein the ellipse unit has two pedals which moves along two respective ellipse tracks and the two pedals each are connected with a roller unit. The rail frame has rails for the roller units to move. The adjustment unit is used for adjusting the inclination of the rails to change the tracks of the pedals. Taiwan Utility No. M341527 (U.S. Pat. No. 7691035) discloses an adjustment unit comprising a link unit, a retractable unit and a positioning unit for positioning the retractable unit. The retractable unit is retracted in length to change the tracks of the pedals so as to have different types of exercising features.

The retractable unit comprises inner tubes and outer tubes. The positioning unit comprises teeth fixed to the outer tubes and the pawls fixed in the inner tubes. The outer tubes have long slots so that the pawls extend through the long slots and are engaged with the teeth. However, the inner tubes are fixed to the positioning parts which have pawls connected thereto. The positioning parts are movable within the slots which has limited space so that the range of adjustment for the tracks of the pedals is limited. The strength of the outer tubes is weakened if the long slots are increased. The retractable unit is connected to the rail frame by two link units which are complicated.

The present invention intends to provide an inclination adjustment unit of an ellipse exerciser so as to improve the shortcomings mentioned above.

SUMMARY OF THE INVENTION

The present invention relates to an ellipse exerciser and comprises a base, a rail frame having two rails, an ellipse unit having two pedals and two roller units, and an adjustment unit having a bottom part and a support frame. The roller units are moved along the rails of the rail frame. The bottom part has two slots and each slot has teeth. Two guide boards are pivotably connected to the two respective outsides of the bottom part. Each guide board is connected with a spring. The support frame has a rod and two ends of the rod are respectively engaged with the slots. The guide boards each have a stop portion to guide the rods. When the support frame is rotated to different angular positions relative to the bottom part, the rods are engaged with different teeth so as to adjust the inclination of the rails. When the rods are moved to the front end of the slots located at the top of the stop portions, the rods are moved to the rear ends of the slots and then enter the inner ends of the front ends of the slots so as to return the rails to the minimum inclination angle.

The present invention will become more obvious from the following description when taken in connection with the accompanying drawings which show, for purposes of illustration only, a preferred embodiment in accordance with the present invention.

DETAILED DESCRIPTION OF THE PREFERRED EMBODIMENT

Figure 1:
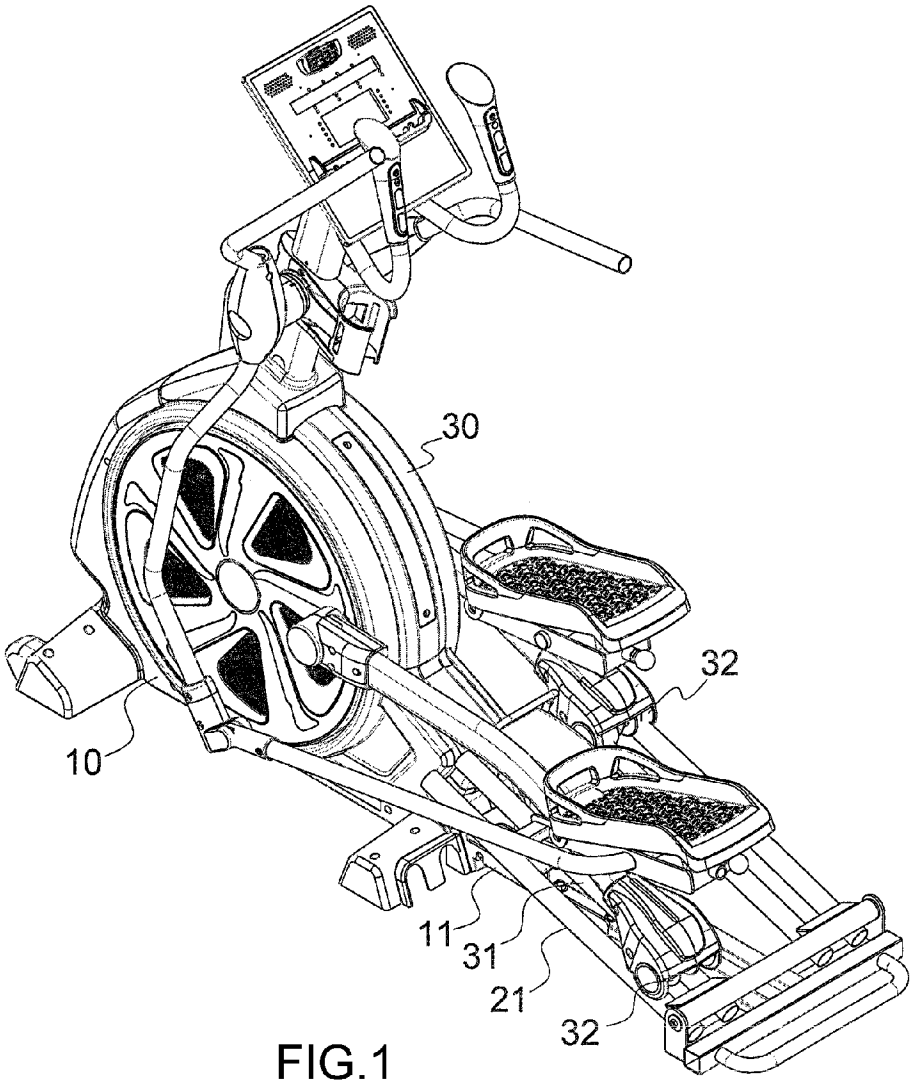
FIG. 1 is a perspective view to show the ellipse exerciser of the present invention.

Referring to FIGS. 1 to 9, the ellipse exerciser of the present invention comprises a base 10, a rail frame 20, an ellipse unit 30 and an adjustment unit 40. The ellipse unit 30 has two pedals 31 which move along two elliptical paths of motion, and each pedal 31 is connected with a roller unit 32. The rail frame 20 has two rails 21 and the two roller units 32 are movable along the two rails 21 of the rail frame 20. The adjustment unit 40 has a bottom part 41 and a support frame 42, wherein the bottom part 41 is fixed to the base 10. When the support frame 42 is rotated to a first angle relative to the bottom part 41, the support frame 42 supports the rail frame 20 to rotate the rail frame 20 to a second angle relative to the base 10. When the support frame 42 is rotated to a third angle relative to the bottom part 41, the support frame 42 supports the rail frame 20 to rotate the rail frame 20 to a fourth angle relative to the base 10.

Figure 6:
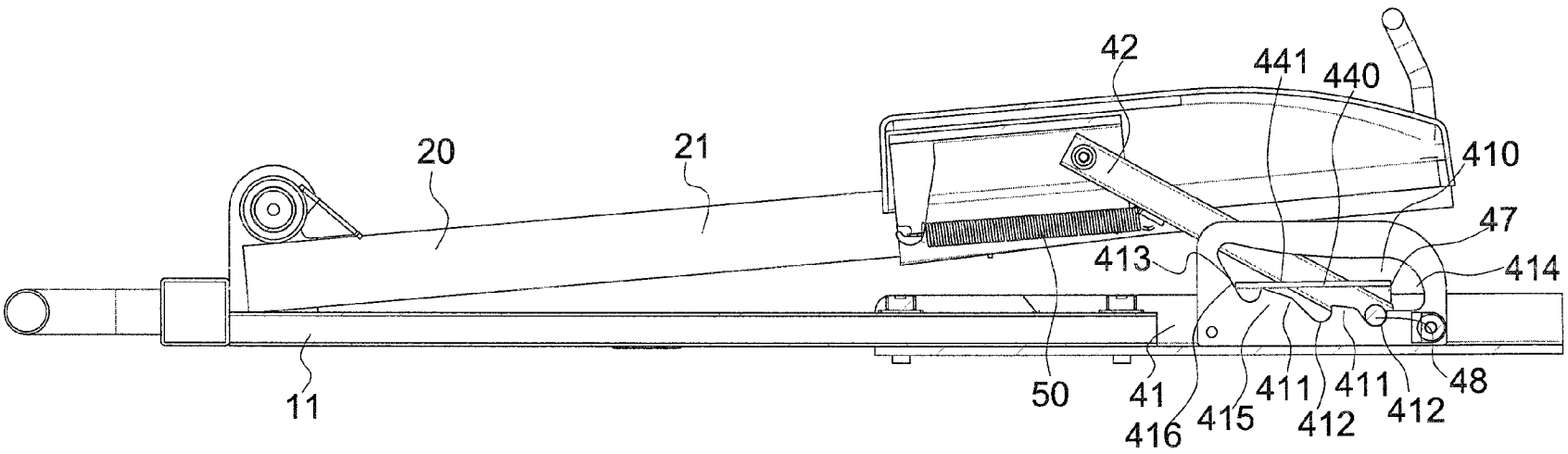
FIG. 6 is a cross sectional view to show that the rod is engaged with the valley between the first and second teeth.

The improvement of the present invention is that the bottom part 41 has two slots 410 and each slot 410 has multiple teeth 411 extending from the inner end thereof. The teeth 411 at a bottom edge of the slot 410 are arranged from the front end 413 toward the rear end 414 of the slot 410. There is a valley 412 defined between any two adjacent teeth 411 and each tooth 411 is inclined toward the front end 413 of the slot 410. The inner end of each of the slots 410 adjacent the front end 413 has a protrusion 415, the top of the protrusion 415 is the maximum height point of the inner end of the slot 410. The front end 413 of the slot 410 has a forward inclined face 416, and a curved recess 417 (as shown in FIG. 6) is formed between the forward inclined face 416 and the protrusion 415. Two guide boards 44 are pivotably connected to two respective outsides of the bottom part 41. A first spring 45 is connected between each of the two guide boards 44 and the bottom part 41. Each guide board 44 has a stop portion 440 bent therefrom. The guide boards 44 each are biased by the first spring 45 to move the stop portion 440 toward the top of the protrusion 415. An opening 47 is formed between the rear end of the stop portion 440 and the inner end of the rear end 414 of the slot 410. The support frame 42 has a rod 48 on the underside thereof, and the diameter of the rod 48 is smaller than the width of the opening 47. When the first spring 45 pushes the guide board 44 to let the stop portion 440 contact the top of the protrusion 415, the distance between the front end of the stop portion 440 and the front end 413 of the slot 410 is smaller than the diameter of the rod 48. The two ends of the rod 48 are respectively engaged with the slots 410.

Figure 7:
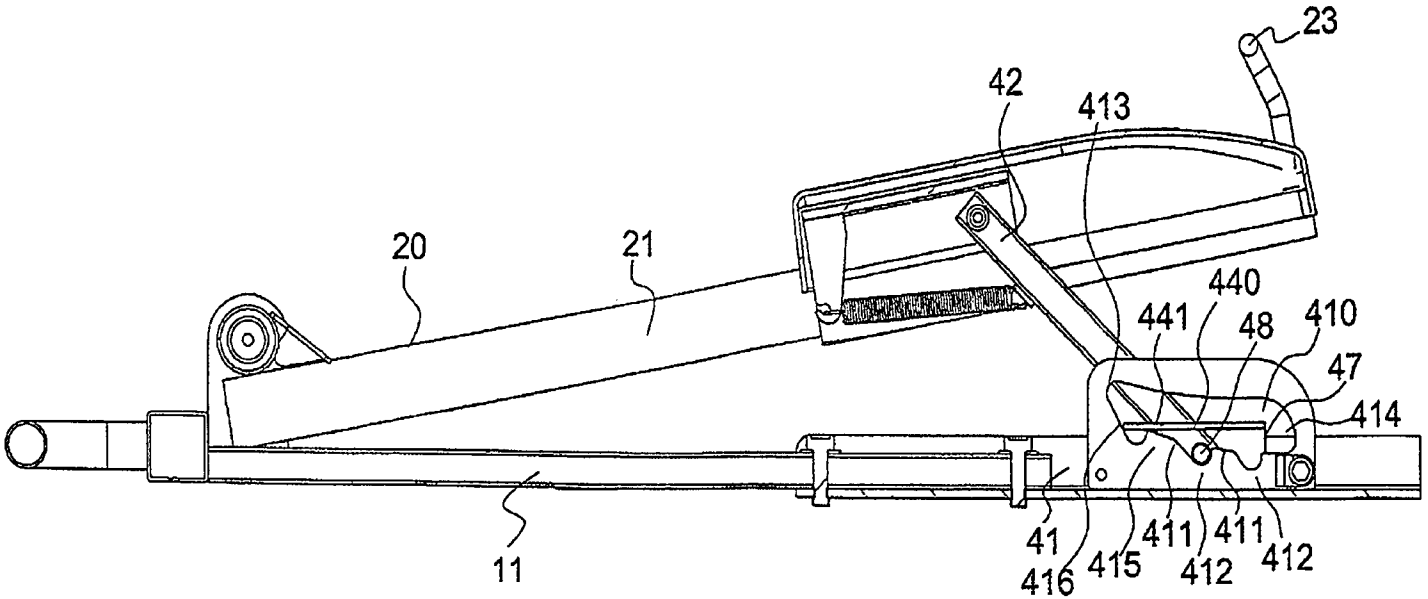
FIG. 7 is a cross sectional view to show that the rod is engaged with the valley between the second and third teeth.
Figure 8:
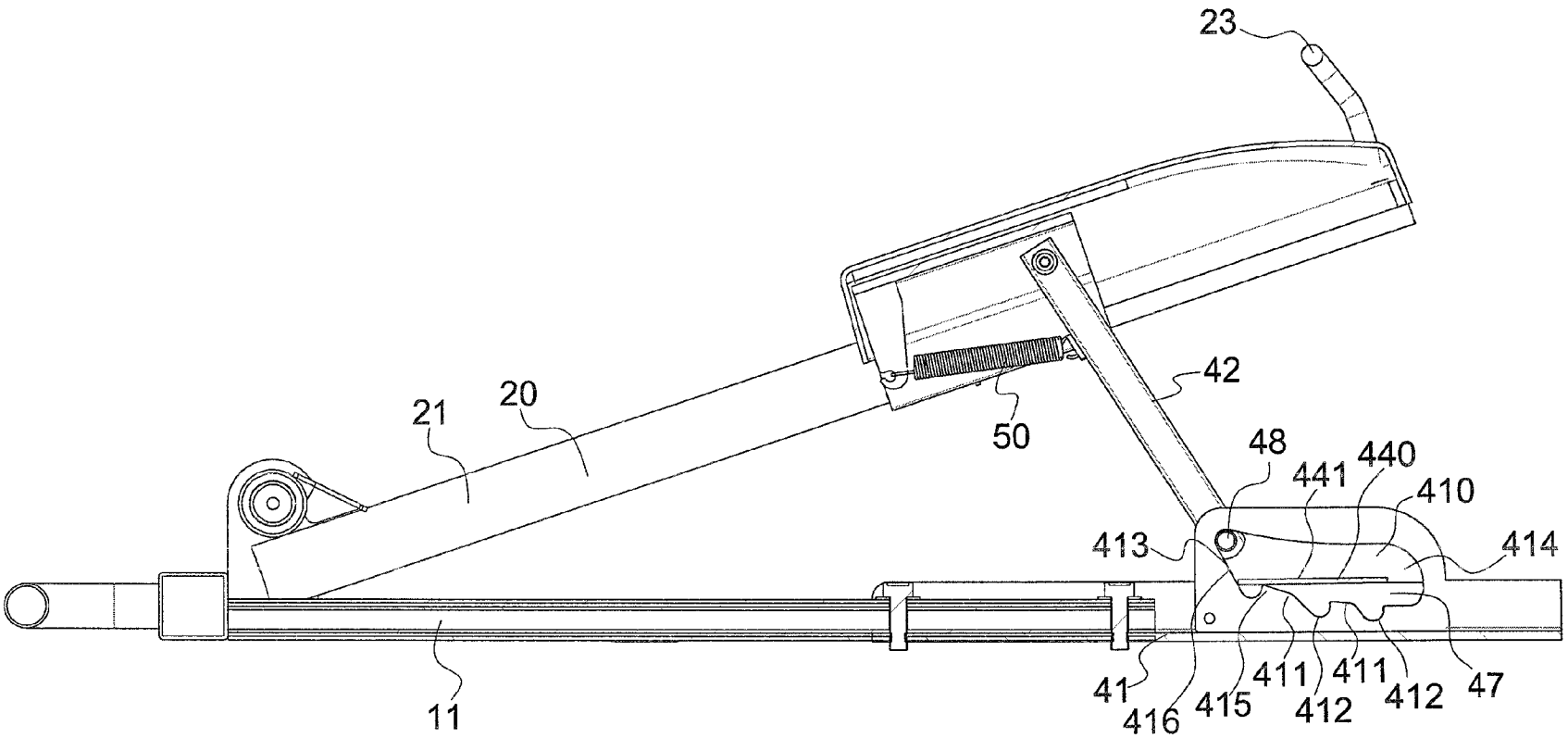
FIG. 8 is a cross sectional view to show that the rod is engaged with the front end of the slot of the bottom part of the adjustment unit.
Figure 9:
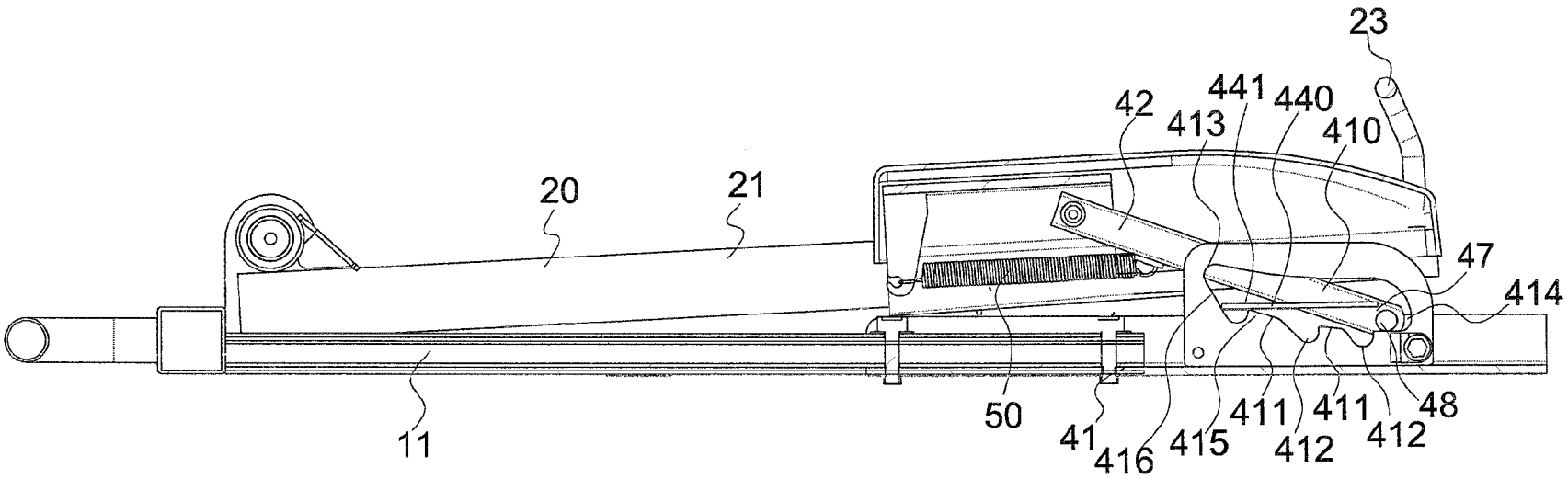
FIG. 9 is a cross sectional view to show that the rod is engaged with the rear end of the slot of the bottom part of the adjustment unit.

When the user pulls or lifts the handle 23 to raise the rail frame 20, the support frame 42 is rotated to the first angle relative to the bottom part 41, the user lowers the rail frame 20 so that the support frame 42 and the rod 48 are moved downward. Each of the stop portions 440 is pulled by the first spring 45 and presses the rod 48 which is engaged with the valley 412 between two adjacent teeth 411 as shown in FIG. 6. When the user continuously lifts the handle 23 and the rail frame 20, the support frame 42 is rotated to the second angle relative to the bottom part 41, the user the lowers the rail frame 20 to move the support frame 42 and the rod 48 downward. Each of the stop portions 440 is pulled by the first spring 45 and presses the rod 48 to be engaged with another valley 412 between the two adjacent teeth 411 as shown in FIG. 7. When the rod 48 is moved forward to the front end 413 of the slot 410 and is moved along the forward inclined face 416 to push the stop portion 440 and overcomes the first spring 45, the rod 48 is separated from the stop portion 440 as shown in FIG. 8. The stop portion 440 is pulled by the first spring 45 and moves to the top of the protrusion 415. The user moves the rail frame 20, the support frame 42 and the rod 48 are moved to the top 441 of the stop portion 440, the rod 48 is movable on the top 441 of the stop portion 440. When the rod 48 moves along the top 441 of the stop portion 440 and to the rear end 414 of the slot 410, the rod 48 enters the inner end of the rear end 414 of the slot 410 via the opening 47, and the rod 48 is located below the stop portion 440 as shown in FIG. 9.

Figure 2:
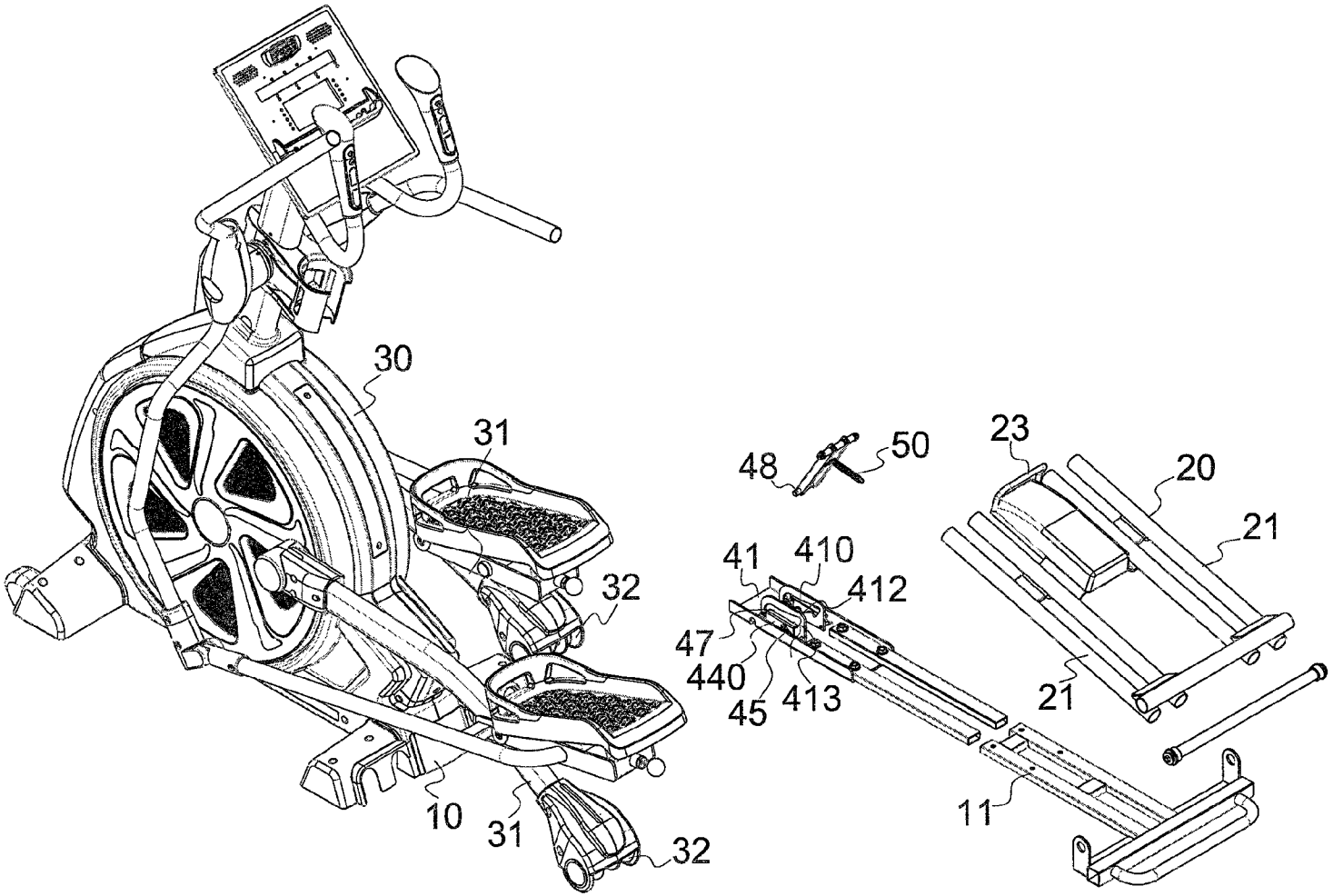
FIG. 2 is an exploded view to show the ellipse exerciser of the present invention.

As shown in FIGS. 1 and 2, a tail portion 11 is connected to the rear end of the rail frame 20 and located at the rear end of the base 10. The top of the support frame 42 is pivotably connected to the rail frame 20 directly. The rod 48 is transversely connected to the lower end of the support frame 42. The angle positioning unit is composed of the bottom part 41, the support frame 42, the slots 410 with teeth 411 and the rail frame 20. This makes the structure of the ellipse exerciser be simple and can be manufacture at lower cost.

As shown in FIGS. 1 and 2, the handle 23 is connected to the front end of the rail frame 20, the rail frame 20 is pivoted about a vertical plane relative to the base 10 when pulling the handle 23. The handle is convenient for the user to adjust the inclination of the rails 21 of the rail frame 20.

As shown in FIGS. 1 and 2, the bottom part 41, the tail portion 11 and the base 10 are three individual parts. The front end of the bottom part 41 is fixed to the rear end of the base 10. The front end of the tail portion 11 is fixed to the rear end of the bottom part 41. By this way, the adjustment unit 40 and the rail frame 20 are combined as a module which is convenient for maintenance, assembled and dis-assembled.

Figure 3:
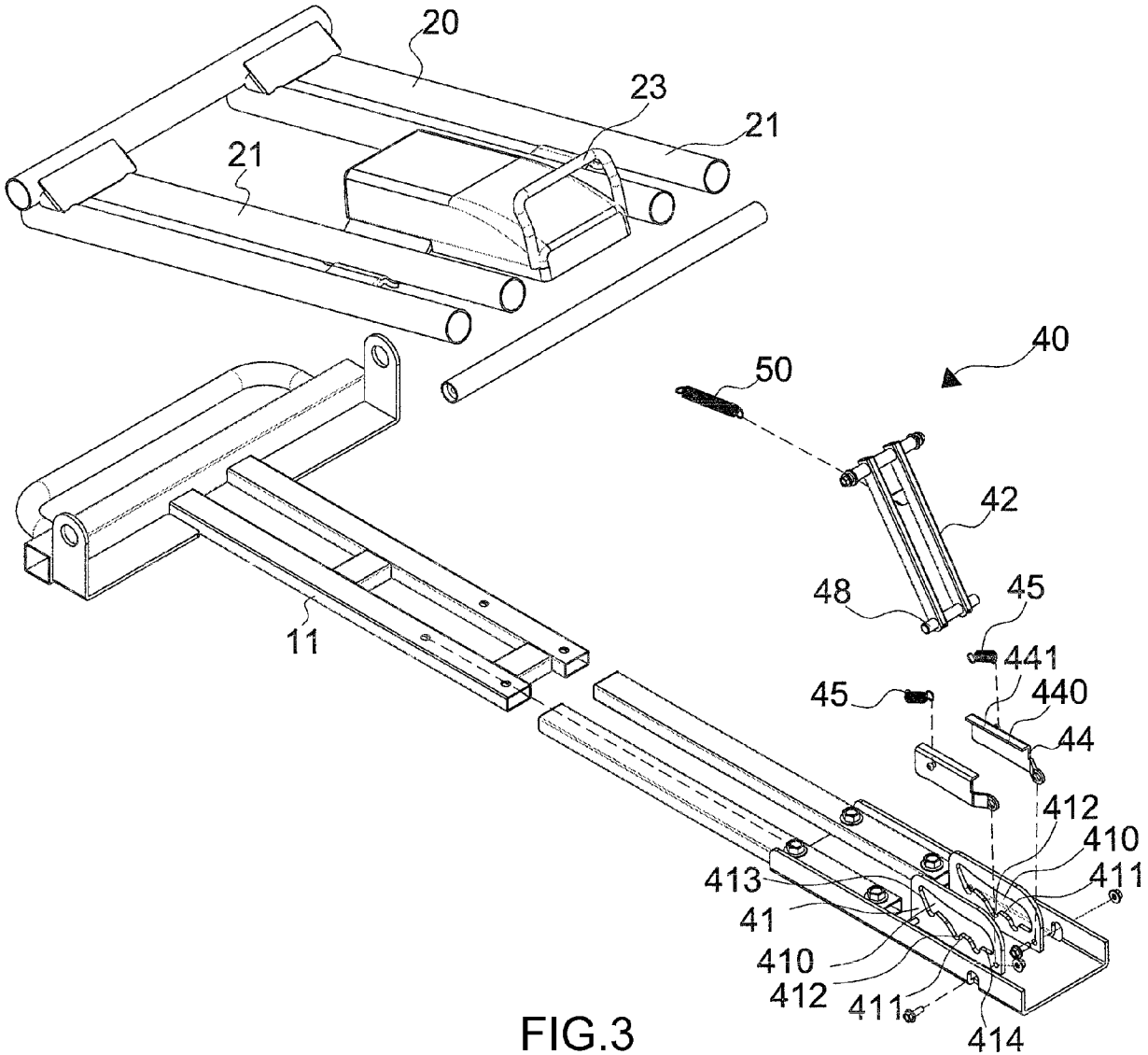
FIG. 3 is an exploded view to show the adjustment unit of the ellipse exerciser of the present invention.
Figure 4:
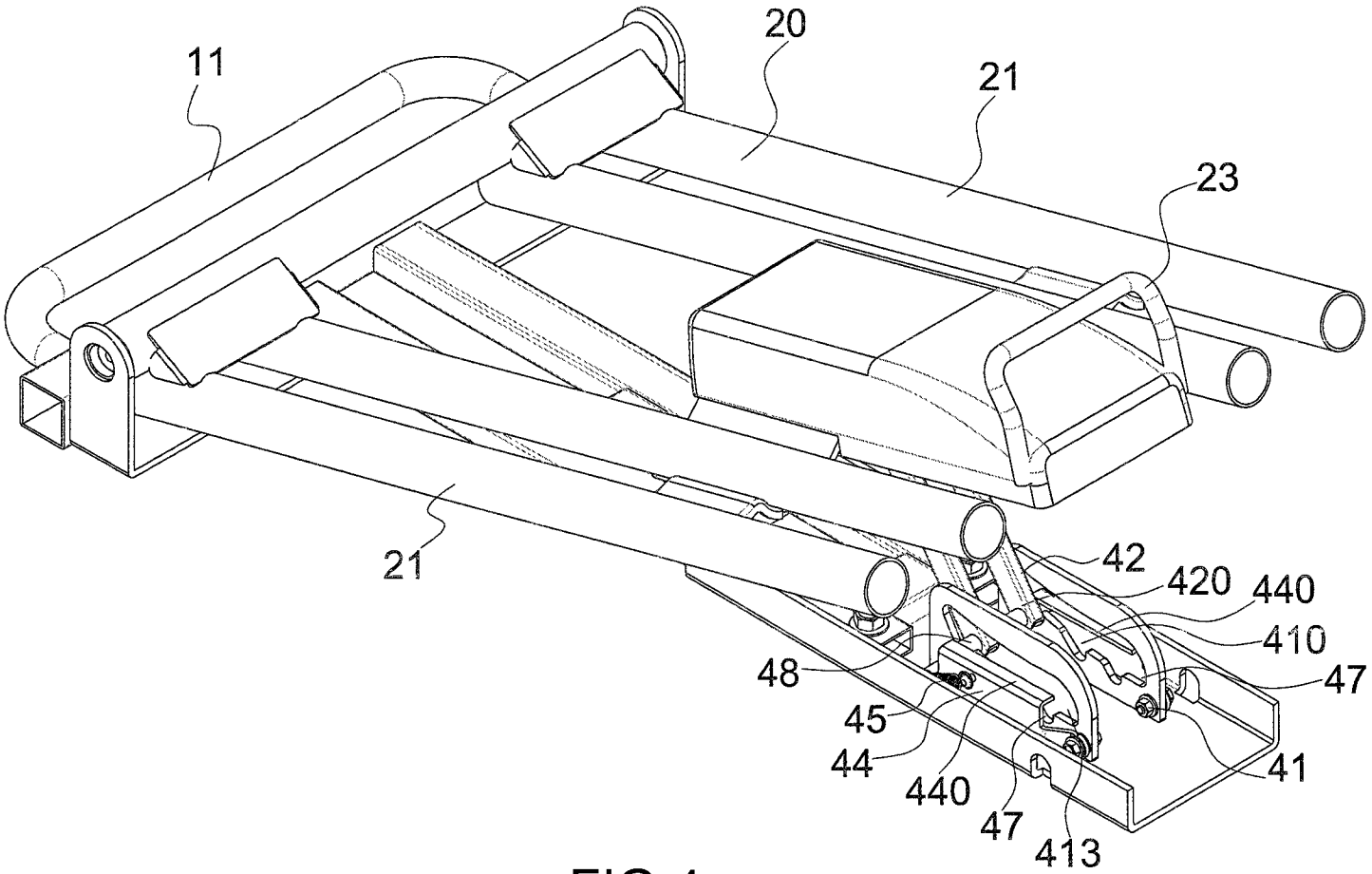
FIG. 4 is a perspective view to show the adjustment unit and the rail frame is located at one position.
Figure 5:
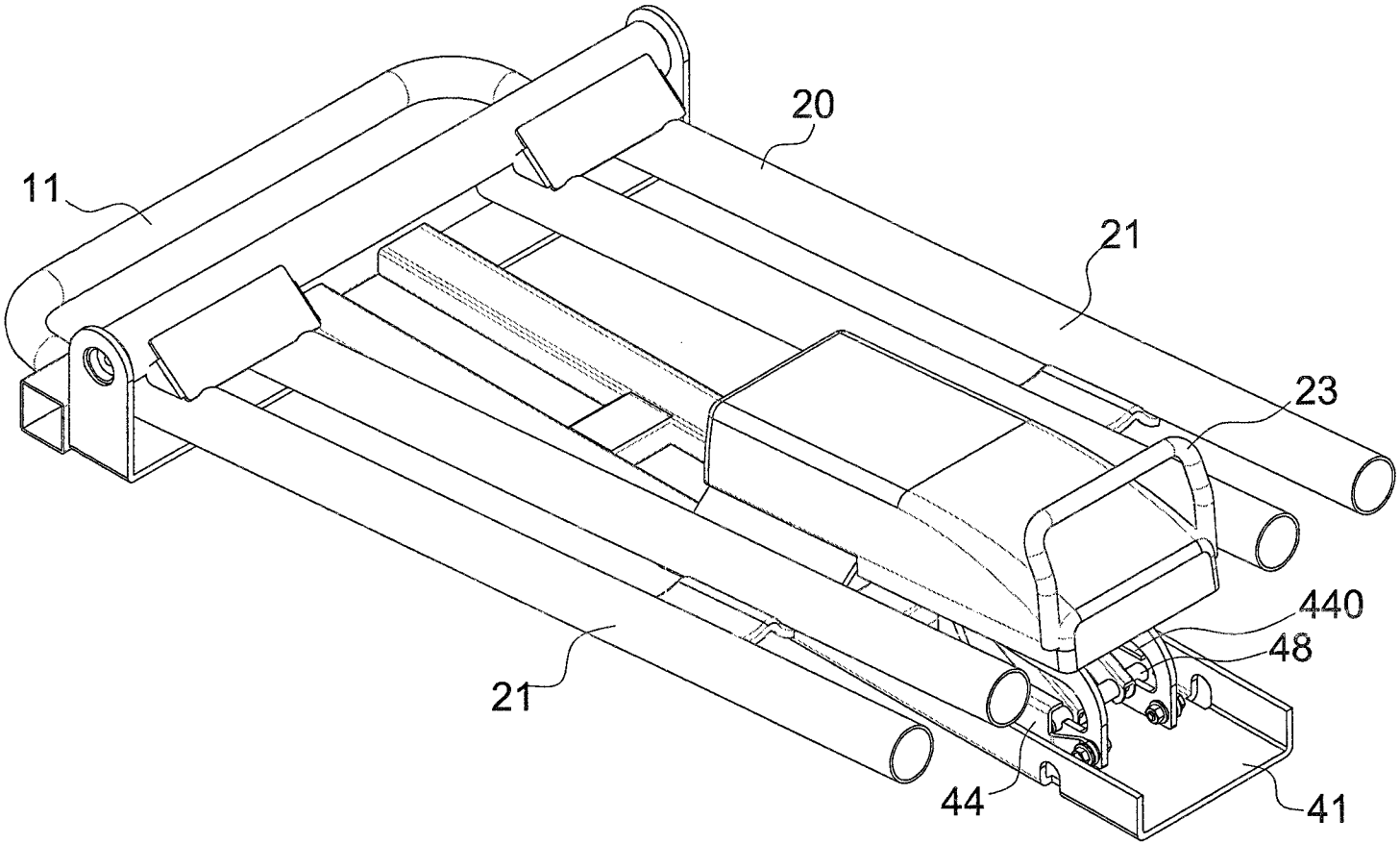
FIG. 5 is a perspective view to show the adjustment unit and the rail frame is located at another position.

As shown in FIGS. 1 to 3, the support frame 42 has a second spring 50 connected thereto so as to provide a force to allow the support frame 42 to be pivoted toward the front end of the rail frame 21 relative to the rail frame 20, such as the disclosure in FIG. 3 which shows that the support frame 42 is pivoted relative to the rail frame 21 clockwise. Also, the second spring 50 allows the rod 48 to be moved toward the front end 413 of the slot 410. In one embodiment, the two ends of the second spring 50 are connected to the rail frame 20 and the support frame 42.

While we have shown and described the embodiment in accordance with the present invention, it should be clear to those skilled in the art that further embodiments may be made without departing from the scope of the present invention.

What is claimed is:

1. An ellipse exerciser comprising:

a base;

a rail frame having two rails;

an ellipse unit having two pedals which move along two elliptical paths of motion, each pedal connected with a roller unit, the two roller units movable along the two rails of the rail frame;

an adjustment unit having a bottom part and a support frame, the bottom part fixed to the base, wherein when the support frame is rotated to a first angle relative to the bottom part, the support frame supporting the rail frame rotates to a second angle relative to the base, wherein when the support frame is rotated to a third angle relative to the bottom part, the support frame supporting the rail frame rotates to a fourth angle relative to the base;

wherein the bottom part having two slots and each slot having multiple teeth extending from an inner end thereof, two guide boards being pivotably connected to two respective outsides of the bottom part, there being two first springs, with each guide board having an individual said spring connecting one of the guide boards and the bottom part, each guide board having a stop portion bent therefrom, the guide boards each are pulled by the first spring to move the stop portion toward the inner end of the slot, the support frame has a rod on an underside thereof and two ends of the rod are respectively engaged with the slots, wherein when the support frame is rotated to the first angle relative to the bottom part, each of the stop portions is pulled by the first spring and presses the rod which is engaged with a valley between one pair of adjacent teeth, wherein when the support frame is rotated to the second angle relative to the bottom part, each of the stop portions is pulled by the first spring and presses the rod which is engaged with another valley between another pair of adjacent teeth, wherein when the rod is moved to a front end of the slot and the rod is moved to a top of the stop portion, the rod is moved on the top of the stop portion, wherein when the rod moves on the top of the stop portion and reaches a rear end of the slot, the rod is located below the stop portion.

2. The exerciser as claimed in claim 1, wherein a tail portion is connected to a rear end of the rail frame and located at a rear end of the base, a top of the support frame is pivotably connected to the rail frame, the rod is transversely connected to a lower end of the support frame.

3. The exerciser as claimed in claim 1, wherein a handle is connected to a front end of the rail frame, the rail frame is pivoted about a vertical plane relative to the base when pulling the handle.

4. The exerciser as claimed in claim 1, wherein the bottom part and the base are individual parts, a front end of the bottom part is fixed to a rear end of the base, a front end of a tail portion is fixed to a rear end of the bottom part.

5. The exerciser as claimed in claim 1, wherein the support frame has a second spring connected thereto so as to provide a force to allow the support frame to be pivoted relative to the rail frame, and to allow the rod to be moved toward the front end of the slot.

6. The exerciser as claimed in claim 1, wherein the inner end of each of the slots has a protrusion, a top of the protrusion is a maximum height point of the inner end of the slot, when the first spring pushes the guide board so that the stop portion contacts the top of the protrusion, an opening is formed between the rear end of the stop portion and an inner end of the rear end of the slot, a diameter of the rod is smaller than a width of the opening, a distance between a front end of the stop portion and the front end of the slot is smaller than the diameter of the rod.

7. The exerciser as claimed in claim 6, wherein the front end of the slot has a forward inclined face, and a curved recess is formed between the forward inclined face and the protrusion.

* * * * *